US005355952A

United States Patent [19]

Meynier

[11] Patent Number: 5,355,952

[45] Date of Patent: Oct. 18, 1994

[54] METHOD AND DEVICE FOR ESTABLISHING AN INTERMITTENT ELECTRIC CONNECTION WITH A STATIONARY TOOL IN A WELL

[75] Inventor: Patrick Meynier, Chatou, France

[73] Assignee: Institut Francais Du Petrole, Rueil-Malmaison, France

[21] Appl. No.: 21,665

[22] Filed: Feb. 24, 1993

[30] Foreign Application Priority Data

Feb. 24, 1992 [FR] France ..... 92 02201

[51] Int. Cl.[5] ..... E21B 47/00; E21B 23/03

[52] U.S. Cl. ..... 166/250; 166/66; 166/117.5

[58] Field of Search ..... 166/66, 72, 250, 65.1, 166/117.5; 73/151, 155

[56] References Cited

U.S. PATENT DOCUMENTS

| | | | |
|---|---|---|---|
| 2,942,671 | 6/1958 | Schramm | 166/117.5 |
| 3,741,299 | 6/1973 | Terral | 166/117.5 |
| 4,119,146 | 10/1978 | Taylor | 166/72 |
| 4,416,330 | 11/1983 | Merritt et al. | 166/117.5 |
| 4,434,847 | 3/1984 | Vazquez et al. | 166/72 |
| 4,624,309 | 11/1986 | Schnatzmeyer | 166/66 |
| 4,646,828 | 3/1987 | Schwab, Jr. et al. | 166/117.5 |
| 4,775,009 | 10/1988 | Wittrisch et al. . | |
| 4,825,946 | 5/1989 | Schnatzmeyer | 166/66 |
| 4,986,350 | 1/1991 | Czernichow . | |
| 5,137,085 | 8/1992 | Goode | 166/117.5 |
| 5,181,565 | 1/1993 | Czernichow . | |

FOREIGN PATENT DOCUMENTS 0433110 6/1991 European Pat. Off. .

*Primary Examiner*—Ramon S. Britts
*Assistant Examiner*—Frank S. Tsay
*Attorney, Agent, or Firm*—Antonelli, Terry, Stout & Kraus

[57] ABSTRACT

An intervention tool (R1, R2) is installed permanently behind a casing pipe or a tubing, in proximity to a tubular section (5) provided with a lateral cavity (6) . A single-contact or a multicontact plug connected to the device is positioned at the bottom of the cavity. A connecting part (9) provided with a retractable finger (10) is lowered into the pipe (2) at the end of a cable (10) comprising one or several conducting lines . A guide ramp (13) allows the finger (10) to be guided towards the cavity (6) when the part (9) comes close thereto. The end of the finger bears a socket (12) adapted for engaging onto the plug (7) . Signals produced by tool (R1, R2) may thus be collected or transmitted thereto at will and only when necessary, without having to establish a permanent link. The invention tool can be used for active or passive monitoring of an oil effluent reservoir for example.

12 Claims, 2 Drawing Sheets

METHOD AND DEVICE FOR ESTABLISHING AN INTERMITTENT ELECTRIC CONNECTION WITH A STATIONARY TOOL IN A WELL

FIELD OF THE INVENTION

The object of the invention is a process and a device for establishing an intermittent communication between any stationary intervention tool or assembly in a well and a surface control and recording station. The intervention assembly may comprise, for example, seismic or acoustic sensors (geophones, hydrophones), condition sensors measuring various parameters: pressures, temperatures, etc, any source of signals, notably a source of acoustic or seismic waves, etc.

The process and the device may be used for example within the scope of operations connected with the monitoring of an underground reservoir and/or the placing in production thereof, notably for oil reservoirs. It is advisable that the intervention assembly be installed permanently in the annular space between a wellbore and a casing pipe or possibly between a casing pipe and a tubing.

BACKGROUND OF THE INVENTION

To complete a well for the production of effluents and notably of oil fluids, a casing pipe is generally lowered therein and held in position by injecting cement into the annular space between the casing and the well. Containment of the well is then achieved by covering it with a wellhead through which a tubing is lowered down to the underground zone or reservoir.

Patents FR-2,593,292 and FR-2,642,849 and patent application Ser. No. 91/11,536 filed by the applicant mention well-known methods and devices for installing permanently, behind a casing pipe, seismic or acoustic receivers, possibly associated with electronic signal processing assemblies, and connected to a surface installation by means of one or several multiline transmission cables. These cables run up to the surface on the outside of the casing and are also embedded in the coupling cement. This kind of linkage with cables has drawbacks. To connect the various lines of these cables to a control and recording station, they have to be run through the wellhead. This requires installation of a wellhead provided with special connectors with sealed terminals or possibly modification of an existing wellhead. Furthermore, difficulties may arise upon cementing of the casing. In fact, the casing may sometimes have to be moved or rotated around its axis so as to better distribute the cement injected and to improve the coupling. It may sometimes happen that the cables are damaged during these operations and that communication with some of the receivers installed in the well is defective. Besides, the presence of cables in the annulus may lead to escape ways for the gaseous effluents contained in the formation crossed by the well.

Published French Patent Applications FR-2,656,034, 2,673,672 and 2,674,029 refer to devices and methods for implementing stationary receivers installed outside a tubing, in the annular space between the tubing and the well or the casing thereof. Like those installed outside a casing, they are connected to a surface control and recording station by means of multiline cables which also have to cross the wellhead through sealed terminals, with the same drawbacks.

There is a well-known process for carrying out measurements in wells by means of accessible measuring instruments. When the production of a reservoir is to be monitored in situ and some significant parameters are to be measured: pressure, temperatures, etc, it is well-known to use tubular strings some sections of which are fitted with bulges inside which side pockets are provided for instruments intended to measure certain parameters and means for recording the variations thereof in time. These instruments are set and, after a certain running time, a specialized tool: mandrel socket, is taken down to them at the end of a cable and they are taken up to the surface to read the data they have stored. This process is adapted for carrying out localized measurements in a location of the well, but the data recovered may only be accessed in a deferred way, by taking the instrument up to the surface.

SUMMARY OF THE INVENTION

The object of the process according to the invention is to establish at will a connection between stationary intervention means installed outside a pipe in a well, without having to remove the tool from the well or to use permanent connecting means running up towards the surface station in the annular space around the pipe.

It comprises:

connecting the intervention means to electric conductors crossing the wall of the pipe, and lowering into the pipe, at the end of a cable, a connecting means adapted for contacting the conductors and thus for communicating with the intervention means.

The conductors are for example installed in a cavity provided in the wall of the pipe, and a connecting means adapted for contacting the conductors in this cavity is lowered into the pipe.

It is possible to use, for example, conductors consisting in at least one plug crossing the wall of the pipe in the cavity, and to lower into the pipe a connecting means comprising at least one mobile socket which, when it is moved apart, can engage onto the plug inside the cavity; guiding means may also be arranged in the pipe to orient the connecting means so as to establish contact when it reaches the level of the cavity.

The intervention means may be fastened on the outside of a casing pipe installed in the well or, for example, on the outside of a tubing lowered in the well.

Through this method, direct communication may for example be established between the intervention means and the surface station, by means of conducting elements inside the cable, or deferred communication may be established between them, the connecting means being used as relays and being moved from one to the other through translation along the pipe.

The invention also relates to an implementing device which comprises a connecting means, a cable for linking the connecting means to the surface station, electric conductors crossing the wall of the pipe and linked electrically to the intervention means, and guiding means for bringing the connecting part in electric contact with said conductors.

The linking cable comprises for example at least one conducting line for linking the connecting means to the surface station.

According to one embodiment, the conductors comprise a plug running through the wall of a cavity provided in the wall of the pipe, and the connecting means comprise a retractable element capable of entering the cavity in a stretched position, a socket adapted for engaging onto the plug and guiding means associated with the pipe for guiding the retractable element towards the cavity.

The plug and the socket are adapted for establishing, by engaging into one another, several different electric connections between the connecting means and the intervention device which comprises, for example, several units arranged in various locations outside the pipe.

The intervention means comprise for example one or several sensors and/or measuring instruments and/or means for emitting signals.

BRIEF DESCRIPTION OF THE DRAWINGS

Other features and advantages of the method and of the device according to the invention will be clear from reading the description hereafter of embodiments given by way of non limitative examples, with reference to the accompanying drawings in which.

DESCRIPTION OF THE PREFERRED EMBODIMENTS

Figure 1:
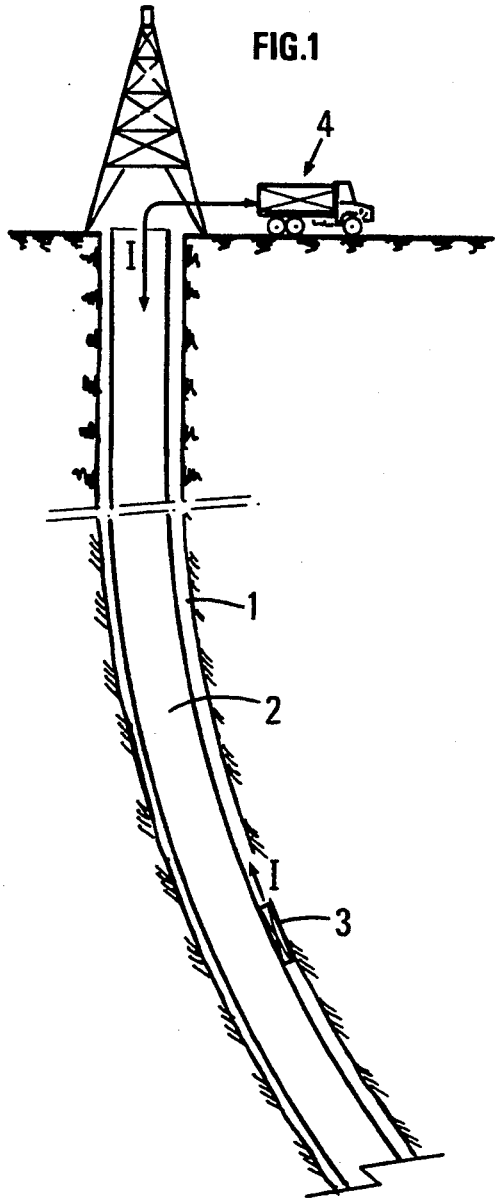
FIG. 1 diagrammatically shows a stationary intervention tool or device arranged in a well, with which communication is to be established.

The well 1 schematized in FIG. 1 is drilled for example through an underground reservoir containing effluents. Such a well is generally completed with a casing pipe 2 which is held in position by injecting cement in the annular space around the casing. As described in the patents cited above, it is possible to install, on the outside of a casing pipe, an intervention tool (or means) 3 of any type, consisting for example in one or several acoustic or seismic receivers, so as to perform operations of active or passive monitoring of the reservoir crossed by the well. This intervention tool 3 is installed permanently at a determined depth of the well, above or at the level of the top of the formation or in a production zone. The method and the device which will be described hereafter allow temporary communications I to be established between the intervention tool 3 and a surface installation comprising a mobile data control and/or recording station 4.

Figure 2:
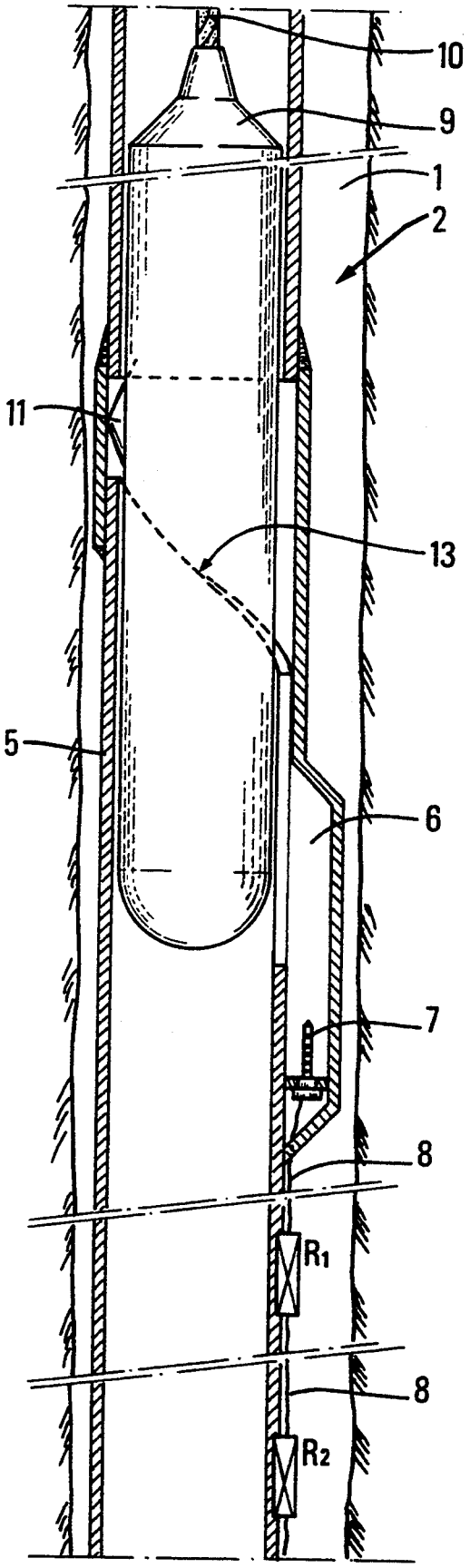
FIG. 2 shows in a more detailed way an intervention tool behind a well casing, and the connecting device according to the invention in a first position.
Figure 3:
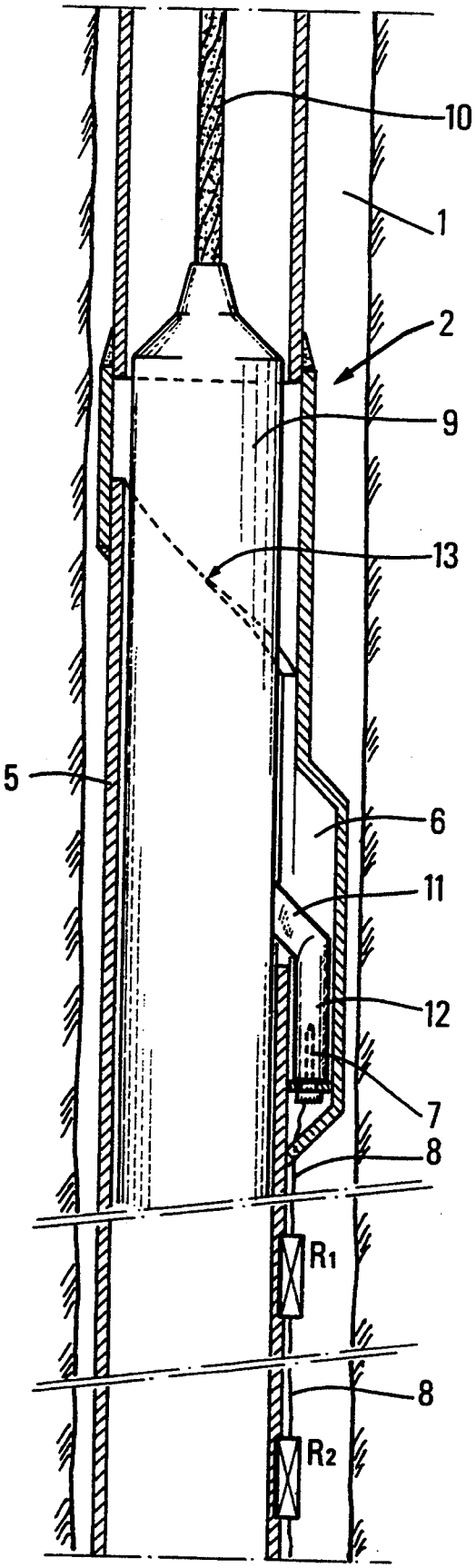
FIG. 3 shows the previous connecting device in the engagement position thereof.

The device according to the invention comprises (FIGS. 2, 3) a modified tubular section 5 which is interposed on the casing pipe 2, in proximity to the zone where the intervention tool is to be set. A lateral cavity 6 is provided in the wall of section 5. The plug may also be located in the connecting tool, and in this case the plug installed at the bottom of the cavity will be a socket. A plug 7 is placed at the bottom of cavity 6. One or several conducting links 8 connect electrically plug 7 to the intervention device. If this device is, as shown in FIG. 2, an array of several sensors R1, R2 . . . , distributed for example at intervals from one another along a portion of the casing pipe, a multicontact plug 7 whose electric contacts are connected respectively through link 8 to the various sensors R1, R2 . . . , is installed.

The device also comprises a connecting part 9 which is lowered into the well from the surface installation, at the end of a cable 10. The section thereof is preferably adapted to the inner section of the pipe. Connecting part 9 comprises a side pocket for a pivoting finger 11. A spring (not shown) exerts on the finger a force tending to move it away from part 9 and to keep it resting on the inner surface of the pipe. At the lower end thereof, finger 11 is fitted with a socket 12 of a size adapted to that of the plug and comprising inwardly as many contacts as on plug 7. Above the lateral cavity, the pipe section 5 is fitted inwardly with a hollow guide ramp 13 whose base reaches substantially the upper level of the cavity. The thickness of ramp 13 is sufficient for finger 11 to rest against it and to follow it, which causes connecting part 9 to rotate around its axis. This ensures that finger 11 engages into cavity 6 (FIG. 3), whatever the angular position of part 9 coming close thereto upon going down the pipe (FIG. 2).

When the pipe is used for casing the well and has to be cemented, a tubular cover (not shown) is installed inside pipe section 5, to prevent the cement injected into the pipe from settling in the cavity and to prevent plugging of the socket onto the plug, this cover being thereafter removed by lowering an appropriate fishing tool.

Figure 4:
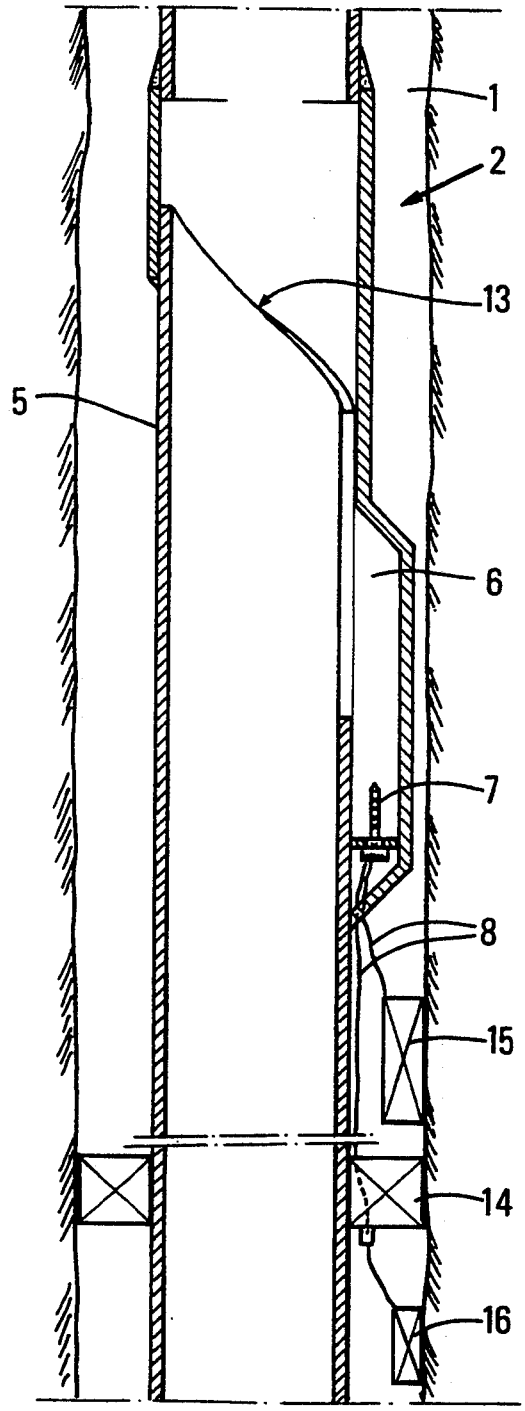
FIG. 4 is a view similar to that of FIG. 2 in the case of a stationary intervention tool arranged behind a tubing.

According to the embodiment of FIG. 4, the device of the invention is adapted to a pipe 2 of a smaller section than that of the well, such as an effluent tubing. According to a well-known lay-out, a containment part 14 such as a packer allows the tubing to be held up and the annular space between the tubing and the well to be sealed so as to canalize from the inside of the tubing the fluids extracted from the formation. The intervention tool may comprise, in this case, elements 15 arranged in this annular space and possibly measuring instruments 16 arranged in the confined part of the well, as described in the above cited patent Applications 2,656,034 and 2,673,672.

The intervention tools may be signal receivers, devices for measuring condition parameters: temperatures, pressures, etc, or sources of waves or radiations of any type necessary for performing investigations in the well.

The connecting part may be lowered into the pipe through the force of gravity alone or, if need be, driven by a current of fluid under pressure.

The connecting part may be connected permanently to the surface station 4 (FIG. 1) through one or several conducting lines so as to receive directly signals coming from the intervention tool 3 and collected through the plugging of socket 12 on plug 7. Without departing from the scope of the invention, however, a two-stage procedure may be applied with a connecting part 9 fitted with data storing means. At first, the connecting part is lowered at the end of the cable and plugged in to collect the data from intervention tool 4. During the second stage, the connecting part 9 is taken up to the surface to read the stored information.

It appears that, in all the cases, it is possible to have free access to a stationary intervention tool installed in a well and to connect thereto without having to cross containment booms. This connection method is suited to a great number of operations which are performed in wells only intermittently, for the purposes of an active or passive monitoring of a formation.

It may for example be a matter of performing seismic surveys with a seismic source arranged in the same well, in another well or at the surface, the intervention device then comprising an array of seismic sensors.

This tool may also be a seismic source installed permanently in the well and which has to be actuated just long enough to carry out a series of emission-reception cycles.

It may also be acoustic or seismic monitoring sensors for recording the noises emitted by a formation during its placing in production, or condition sensors located in the production zone to measure various significant parameters, these sensors being periodically interrogated.

In the embodiment which has been described, the electric connection of the intervention tool is done by plugging in the socket 12 at the end of finger 11 onto a plug 17 located at the bottom of cavity 6.

However, without departing from the scope of the invention, a symmetrical lay-out with a socket located at the bottom of the cavity and a complementary plug at the end of the pivoting finger 11 may also be used.

I claim:

1. A method for establishing at will an intermittent communication between a surface station and a stationary intervention means installed outside of a pipe in a well, said method comprising:

connecting the intervention means outside of the pipe to at least one electric conductor crossing through a wall of the pipe, and lowering into the pipe, at the end of a cable having electric conductor means linked to the surface station, a connecting part adapted to be connected with the at least one conductor and connecting the connecting part to the at least one electric conductor thus establishing electrical communication with the intervention means.

2. A method as claimed in claim 1, wherein an electric connecting end of the at least one conductor is arranged in a cavity provided in a wall portion of the pipe, and an electrical connecting portion of the connecting part adapted for contacting the conductors in this cavity is introduced into the cavity.

3. A method as claimed in claim 2, wherein said connecting part has a pivotal finger extending outwardly therefrom and guiding means are arranged on an inside wall of the pipe to orient the connecting part, said method further comprising engaging the finger with said guiding means so that the electrical connecting portion of the connecting part is introduced into said cavity and is connected to said end of the at least one conductor.

4. A device for intermittently connecting a stationary intervention means positioned outside a pipe in a well with a surface station, thereby allowing an electrical communication to be established between the stationary intervention means and the surface station, said device comprising a connecting means, a conductor cable for linking the connecting means to the surface station, at least one electric conductor crossing through a wall of the pipe and connected electrically to the intervention means, and guiding means for bringing the connecting part in electrical contact with said at least one conductor.

5. A device as claimed in claim 4, wherein said cable comprises at least one electrical conducting line for linking the connecting means to the surface station.

6. A device as claimed in any one of claims 4 or 5, wherein said at least one conductor comprises a plug extending through the wall of the pipe at a portion of the pipe defining a cavity extending outwardly from a main portion of said pipe, said connecting part comprising a retractable element which may enter the cavity in an extended position, an electric socket adapted for engaging onto said plug and said guiding means being associated with the pipe for guiding the retractable element towards the cavity.

7. A device as claimed in claim 4, wherein the guiding means comprise a guide ramp.

8. A device as claimed in claim 4, wherein the intervention means comprise at least one one sensor.

9. A device as claimed in claim 4, wherein the intervention means comprise at least one measuring instrument.

10. A device as claimed in claim 4, wherein the intervention means comprise means for emitting signals.

11. A method for intermittently connecting a stationary intervention means positioned outside a pipe in a well with a surface station, comprising:

connecting said intervention means to at least one electric conductor extending through a wall of the pipe, lowering into said well a conductor cable linked to the surface station, a lower end of the cable being provided with a connecting means adapted to be connected to said at least one electric conductor and positioning the connecting means in electrical contact with said at least one electric conductor thereby establishing electrical communication with the intervention means positioned outside said pipe.

12. A method for intermittently connecting a stationary intervention means positioned outside a casing pipe cemented in a well with a surface station, comprising:

connecting said intervention means to at least one electric conductor crossing through a wall of the pipe and connected to said stationary intervention means;

lowering into said pipe a conductor cable linked to the surface station, a lower end of said cable being provided with a connecting means adapted to be electrically connected with said at least one electric conductor; and positioning said connecting means in electrical contact with said at least one electric conductor thereby establishing electrical communication with the intervention means positioned outside the casing pipe.

* * * * *